US009724946B2

(12) United States Patent
Saito

(10) Patent No.: US 9,724,946 B2
(45) Date of Patent: Aug. 8, 2017

(54) HEAD ATTACHMENT/DETACHMENT JIG, AND HEAD REPLACEMENT JIG

(71) Applicant: Akira Saito, Ebina (JP)

(72) Inventor: Akira Saito, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 395 days.

(21) Appl. No.: 14/173,185

(22) Filed: Feb. 5, 2014

(65) Prior Publication Data

US 2014/0237787 A1 Aug. 28, 2014

(30) Foreign Application Priority Data

Feb. 28, 2013 (JP) ..... 2013-038310

(51) Int. Cl.

| | |
|---|---|
| ***B41J 29/00*** | (2006.01) |
| ***B41J 25/34*** | (2006.01) |
| *B41J 2/145* | (2006.01) |
| *B41J 25/00* | (2006.01) |
| *B41J 2/155* | (2006.01) |

(52) U.S. Cl.

CPC ..... *B41J 25/34* (2013.01); *B41J 2/145* (2013.01); *B41J 2/155* (2013.01); *B41J 25/001* (2013.01); *B41J 2202/19* (2013.01); *B41J 2202/20* (2013.01); *Y10T 29/53909* (2015.01)

(58) Field of Classification Search

CPC ..... B41J 2202/20; B41J 2/155; B41J 29/00; B41J 25/00; B41J 25/001; B41J 25/003; B41J 25/005; B41J 25/304; B41J 25/308; B41J 2202/19; B41J 2202/155;

(Continued)

(56) References Cited

U.S. PATENT DOCUMENTS 3,372,279 A * 3/1968 Engh ..... G01J 1/429 250/372
4,304,035 A * 12/1981 Ecker ..... B25B 27/26 29/213.1

(Continued)

FOREIGN PATENT DOCUMENTS

JP 60020829 * 7/1983
JP 2010173242 A * 1/2006

(Continued)

OTHER PUBLICATIONS

Sep. 28, 2016 Japanese official action in connection with corresponding Japanese patent Application No. 2013-038310.

*Primary Examiner* — Larry E Waggle, Jr.
*Assistant Examiner* — Mahdi H Nejad
(74) *Attorney, Agent, or Firm* — Cooper & Dunham LLP

(57) ABSTRACT

A head attachment/detachment jig that is used for attachment/detachment of a head which ejects ink droplets and is fixed on a base member by a fastener member when replacing the head, the head attachment/detachment jig, includes a frame member that is attachable to and detachable from the head; and a tip tool that has a tip part and a top part, and is held to be turnable and movable forward and backward with respect to the frame member, wherein the tip part of the tip tool has a shape that is capable of turning the fastener member, and the top part of the tool has a shape that is formed to be capable of turning the tip tool by a different tool from the tip tool.

8 Claims, 18 Drawing Sheets

(58) Field of Classification Search
CPC ..... B41J 25/34; B23P 19/027; B23P 19/048; B23Q 3/082; B25B 11/02; Y10T 29/53909
USPC ..... 347/40, 20, 37; 29/270, 255, 278, 252, 29/279, 271; 227/134, 138, 15, 8; 81/57.32
See application file for complete search history.

(56) References Cited

U.S. PATENT DOCUMENTS 5,694,159 A * 12/1997 Kajiya ..... B41J 25/316 347/197
6,154,954 A * 12/2000 Seto ..... H05K 13/0408 29/740
7,496,999 B2 * 3/2009 Robarge ..... B25B 13/48 29/255
7,661,335 B2 * 2/2010 Kuboyama ..... B23P 19/066 81/54
7,779,734 B2 * 8/2010 Nichols, Jr. ..... B25B 23/101 81/452
7,942,497 B1 * 5/2011 Matsumoto ..... B41J 2/155 347/20
8,342,653 B2 * 1/2013 Akahane ..... B41J 2/2135 347/42
8,827,579 B2 * 9/2014 Yajima ..... B41J 29/02 347/20
8,844,409 B2 * 9/2014 Lin ..... B25B 23/0035 173/90
9,085,166 B1 * 7/2015 Takagiwa ..... B41J 2/17503
9,126,445 B1 * 9/2015 Spence ..... B41J 25/34
9,206,577 B2 * 12/2015 Lusk ..... E02D 7/04
2002/0024554 A1 * 2/2002 Tominaga ..... B41J 2/14024 347/37
2002/0033857 A1 * 3/2002 Ohashi ..... B41J 2/14024 347/20
2005/0212866 A1 * 9/2005 Furuya ..... B41J 2/14274 347/70
2006/0075856 A1 * 4/2006 Tilton ..... B25B 23/101 81/452
2006/0290725 A1 * 12/2006 Akahane ..... B41J 2/2135 347/9
2007/0154258 A1 * 7/2007 Knapp ..... F16B 12/20 403/331
2008/0145130 A1 * 6/2008 Marsden ..... B41J 2/145 400/692
2008/0186353 A1 * 8/2008 Parks ..... B41J 25/001 347/37
2008/0314204 A1 * 12/2008 Kuboyama ..... B23P 19/066 81/57.42
2008/0314206 A1 * 12/2008 Akita ..... B23P 19/066 81/440
2009/0174750 A1 7/2009 Saito
2009/0225130 A1 9/2009 Saito
2009/0273619 A1 * 11/2009 Akahane ..... B41J 2/2135 347/8
2010/0043185 A1 * 2/2010 Baumgartner ..... B60R 21/18 24/595.1
2010/0218360 A1 * 9/2010 Mangone, Jr. ..... E04G 21/122 29/525.01
2010/0245480 A1 * 9/2010 Suzuki ..... B41J 2/155 347/50
2010/0328372 A1 * 12/2010 Chuang ..... B41J 25/308 347/8
2011/0128323 A1 6/2011 Saito
2011/0216128 A1 9/2011 Saito
2011/0314976 A1 * 12/2011 Anjanappa ..... B25B 23/1427 81/480
2012/0024117 A1 * 2/2012 Kreutzer ..... B25B 19/00 81/463
2012/0113190 A1 * 5/2012 Wachter ..... B41J 2/155 347/40
2012/0249677 A1 * 10/2012 Tsao ..... B41J 25/001 347/37
2013/0093816 A1 * 4/2013 Balsells Mercad .. B41J 25/3086 347/37
2013/0205569 A1 * 8/2013 Nino ..... A61B 17/8883 29/460
2014/0168303 A1 * 6/2014 Moreau ..... B41J 2/155 347/14
2014/0168319 A1 * 6/2014 Moreau ..... B41J 2/145 347/49
2015/0343813 A1 * 12/2015 Komiya ..... B41J 11/20 347/20

FOREIGN PATENT DOCUMENTS

JP 2013184468 A * 1/2006
JP 2010-173242 8/2010
JP 2012-161992 8/2012
JP 2013-184468 9/2013

* cited by examiner

HEAD ATTACHMENT/DETACHMENT JIG, AND HEAD REPLACEMENT JIG

CROSS-REFERENCE TO RELATED APPLICATIONS

The present application is based on and claims priority from Japanese Patent Application Number 2013-038310, filed Feb. 28, 2013, the disclosure of which is hereby incorporated by reference herein in its entirety.

BACKGROUND

The present invention relates to a head attachment/detachment g, and a head replacement jig.

As an image-forming device such as a printer, a fax machine, a copier, a plotter, a multifunctional device having those functions, or the like, an inkjet recording device, or the like is known as a liquid-ejection-recording-type image-forming device using a recording head constituted of a liquid ejection head (droplet ejection head) which ejects ink droplets, for example.

It is known that in such an image-forming device, when malfunction of the recording head occurs, the head is replaced.

For example, Japanese Patent Application Publication Number 2010-173242 discloses a method of adjusting a position of a recording head, where when a recording head that ejects ink held by a head holder is removed and a new recording head is held by the head holder, a position adjustment jig adjusts a position of the new recording head with respect to the head holder. In the method, three steps are performed, in which a first step in which in a state where the recording head to be removed is held by the head holder, the position adjustment jig is attached to the head holder, a second step in which after the first step, the recording head to be removed is removed from the head holder in a state of keeping the position adjustment jig in a state of the first step, and a third step in which after the second step, the new recording head is attached to the head holder via the position adjustment jig kept in the state of the first step are included.

Incidentally, especially in an image-forming device having a line-type head in which a plurality of heads are arranged on a base member, gaps between the arranged heads are extremely narrow. In addition, in a case of having a head unit integrally formed with a head tank that supplies liquid to the heads, the height of the entire head unit becomes high.

Therefore, in order to perform a head replacement, a head replacement jig is fixed to an extremely narrow and deep space between the heads, a head to be replaced is removed, and a new head is positioned and fixed.

More specifically, when replacing a head, it is necessary to access a fixing screw that fixes a head located on the bottom of the extremely narrow and deep space between the heads to a base member, and a fixing screw that fixes the head replacement jig to the base member with a screwdriver.

Therefore, there are problems of poor visibility, poor workability, and moreover, the occurrence of problems such as dropping off of the fixing screws when attaching/detaching the head and the head replacement jig, and the like.

SUMMARY

An object of the present invention is to make a head replacement operation easy.

In order to achieve the above object, an embodiment of the present invention provides: a head attachment/detachment jig that is used for attachment/detachment of a head which ejects ink droplets and is fixed on a base member by a fastener member when replacing the head, the head attachment/detachment jig, comprising: a frame member that is attachable to and detachable from the head; and a tip tool that has a tip part and a top part, and is held to be turnable and movable forward and backward with respect to the frame member, wherein the tip part of the tip tool has a shape that is capable of turning the fastener member, and the top part of the tip tool has a shape that is formed to be capable of turning the tip tool by a different tool from the tip tool.

In order to achieve the above object, an embodiment of the present invention provides: a head replacement jig that is used for replacement of a head which ejects ink droplets and is fixed on a base member by a fastener member when replacing the head, the head replacement jig, comprising: a frame member; a jig-fixing screw that has a tip part and a top part, is held to be turnable and movable forward and backward with respect to the frame member, and fixes the head replacement jig on the base member, wherein the tip part of the jig-fixing screw has a shape that is capable of being screwed in the base member, and a top part of the jig-fixing screw has a shape that is formed to be capable of turning the jig-fixing screw by a tool.

Figure 6A:
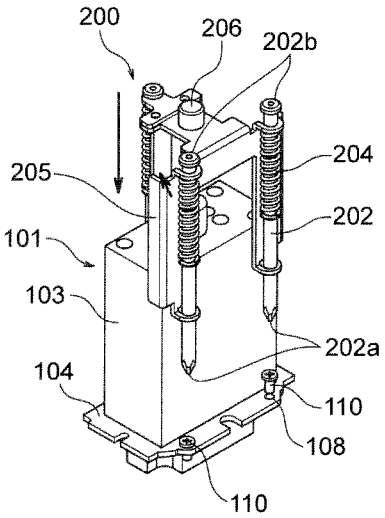
Figure 6B:
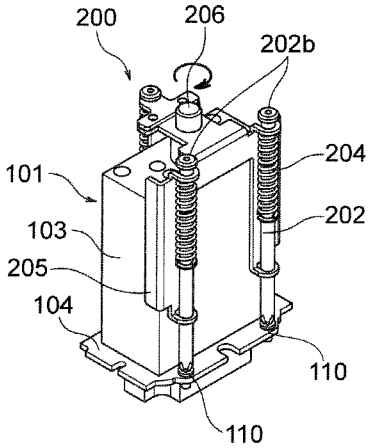

Each of FIGS. 6A and 6B is a perspective explanatory diagram explaining a state when setting a head to the head attachment/detachment jig.

Figure 7:
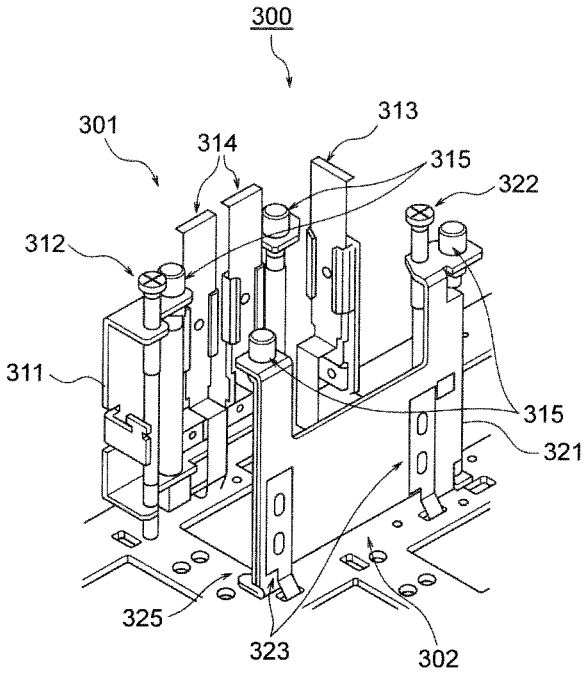

FIG. 7 is a perspective explanatory diagram of an example of a head replacement jig according to the embodiment of the present invention.

Figure 8:
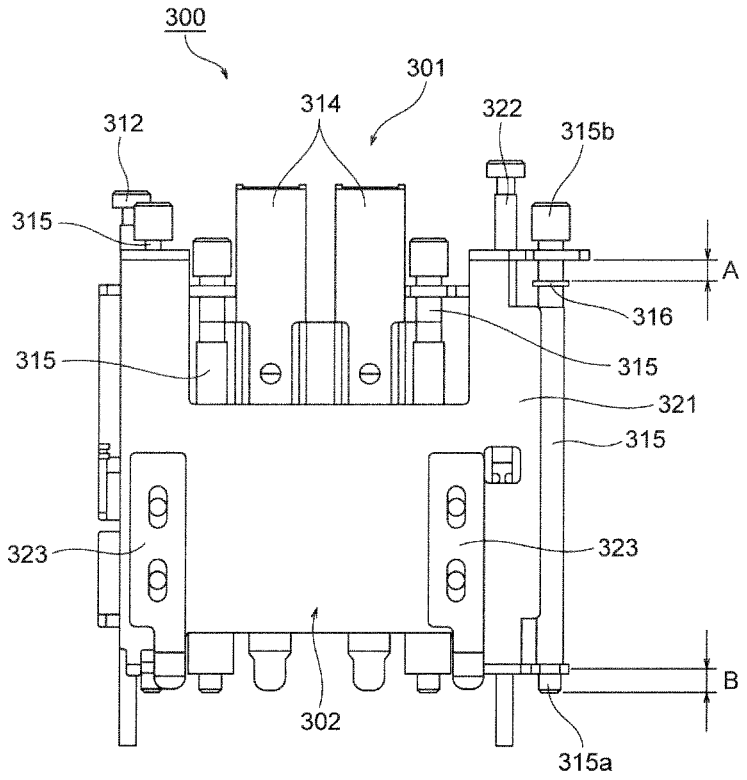

FIG. 8 is a front explanatory diagram of the head replacement jig.

Figure 9:
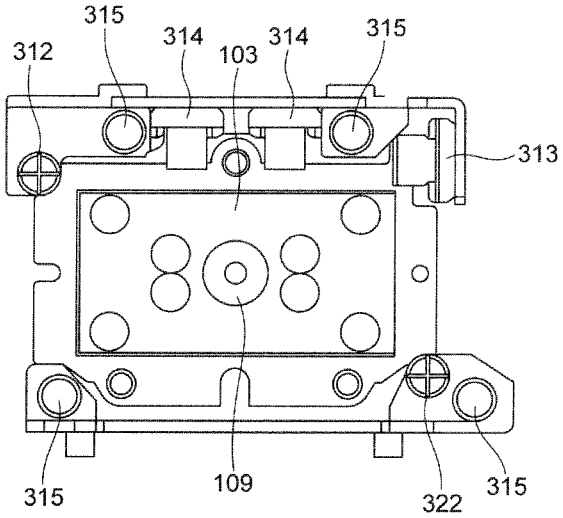

FIG. 9 is a plan explanatory diagram explaining a state where the head attachment/detachment jig is set to a head.

Figure 10:
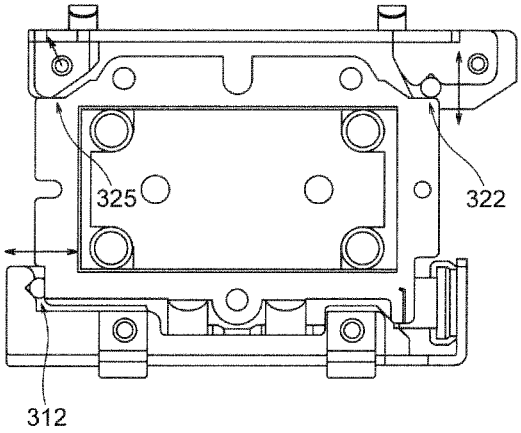

FIG. 10 is a bottom explanatory diagram of the head replacement jig.

Figure 11A:
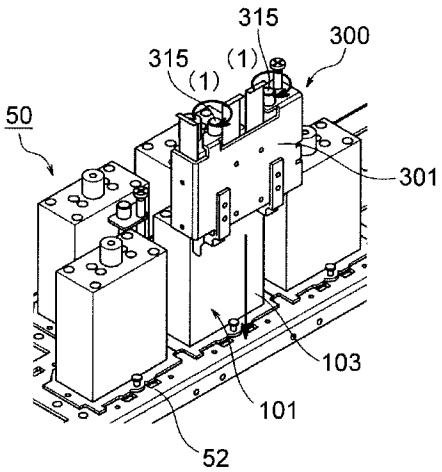
Figure 11B:
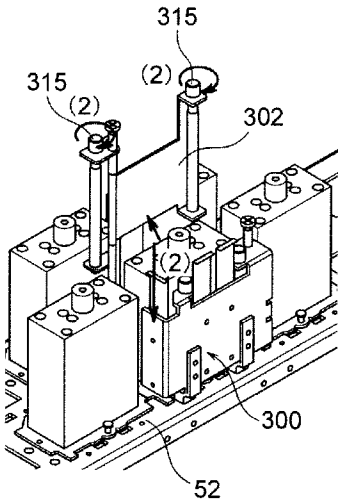
Figure 11C:
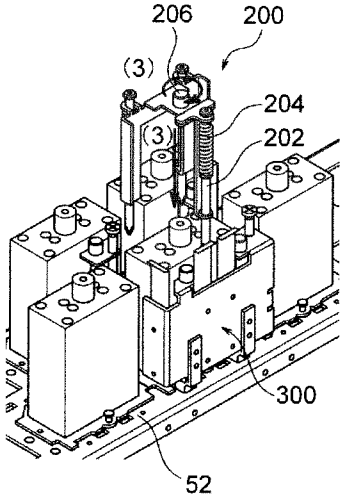

Each of FIGS. 11A, 11B, and 11C is an explanatory diagram explaining the procedures for fixing the head replacement jig and the head attachment/detachment jig.

Figure 12B:
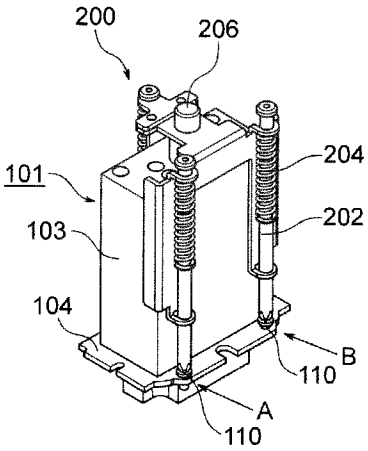
Figure 12A:
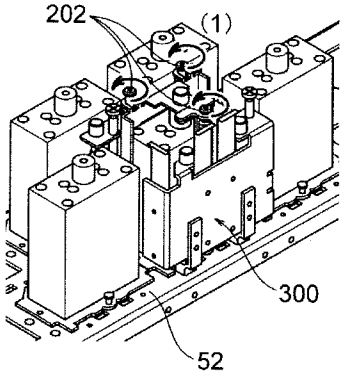

Each of FIGS. 12A and 12B is an explanatory diagram explaining the procedures for unfastening a fixing screw of a head to be removed.

Figure 13B:
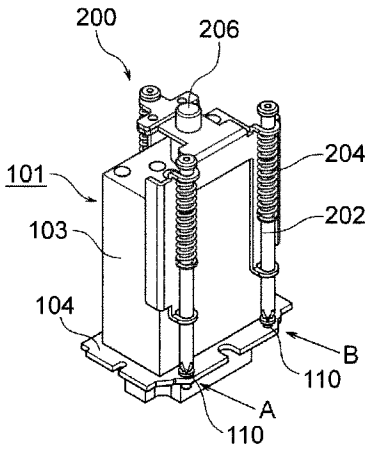
Figure 13A:
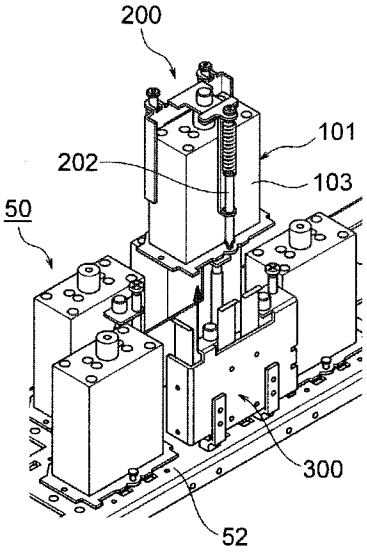

Each of FIGS. 13A and 13B is an explanatory diagram explaining the procedures for removing a head to be removed.

Figure 14A:
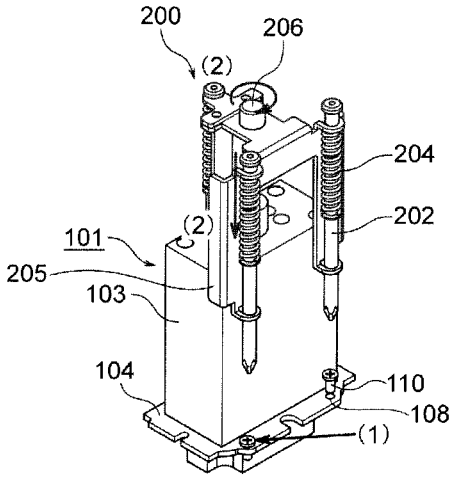
Figure 14B:
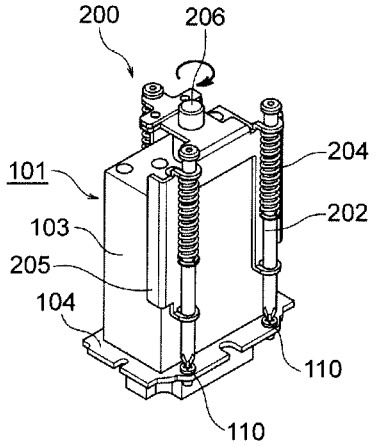

Each of FIGS. 14A and 14B is an explanatory diagram explaining the procedures for setting the head attachment/detachment jig to a new head.

Figure 15:
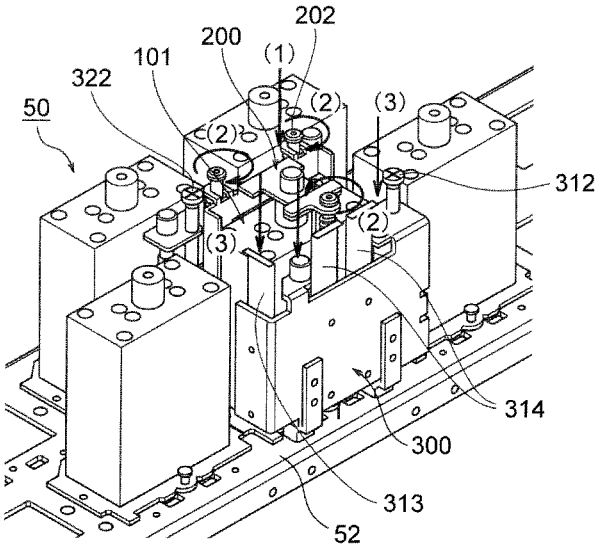

FIG. 15 is an explanatory diagram explaining the procedures for temporarily fixing the new head to an array base member and adjusting a position.

Figure 16:
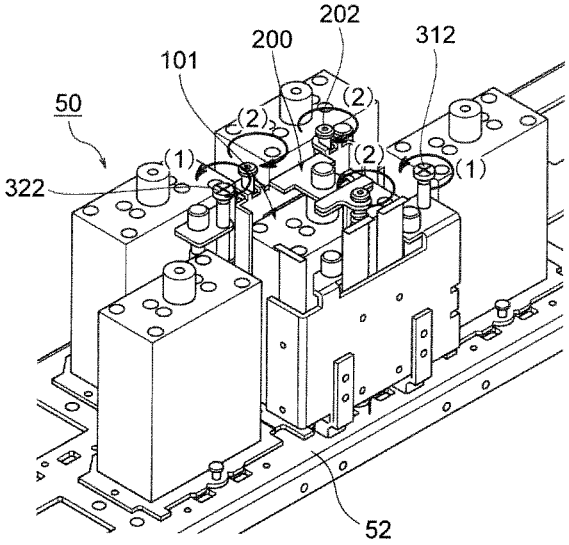

FIG. 16 is an explanatory diagram explaining the procedures for adjusting a position of the new head.

Figure 17:
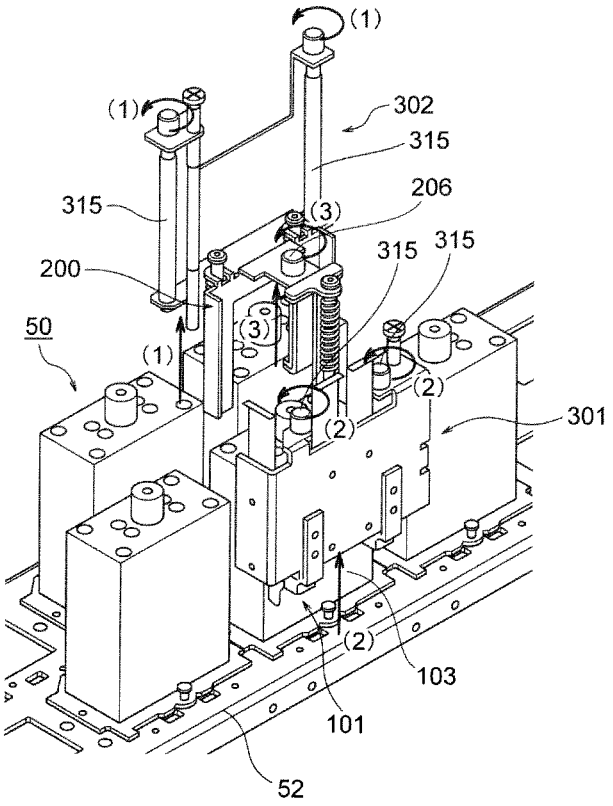

FIG. 17 is an explanatory diagram explaining the procedures for removing the jigs.

Figure 18:
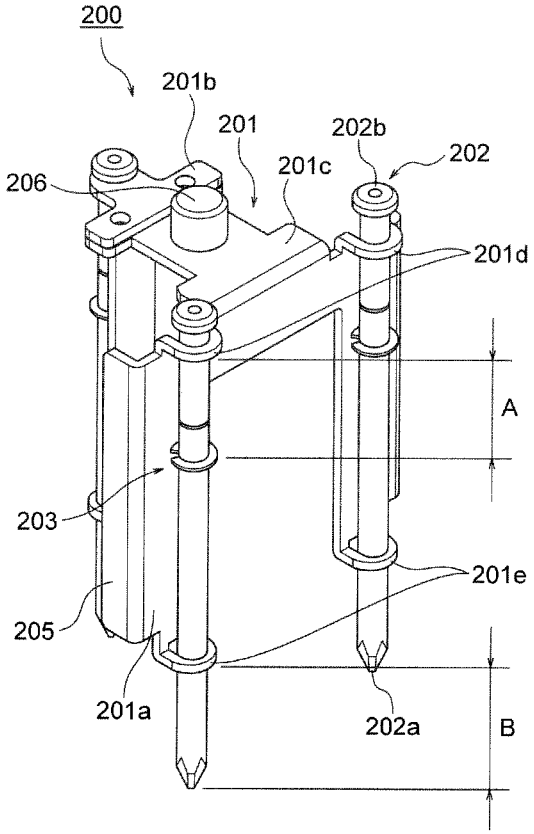

FIG. 18 is a perspective explanatory diagram of a head attachment/detachment jig according to a second embodiment of the present invention.

DETAILED DESCRIPTION OF THE PREFERRED EMBODIMENTS

Figure 1:
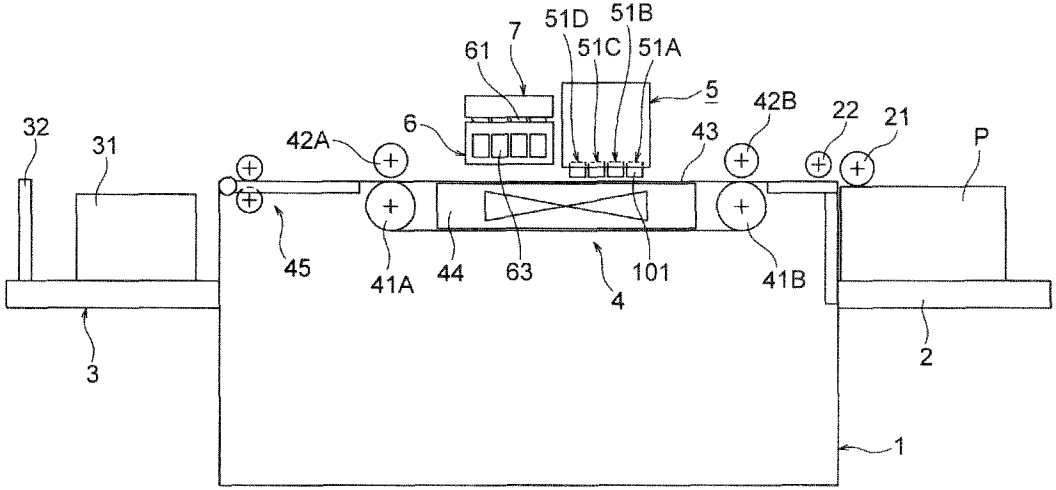
FIG. 1 is a schematic configuration diagram explaining an entire configuration of an example of an image-forming device in which a head replacement is performed by using a head attachment/detachment jig, and a head replacement jig according to an embodiment of the present invention.
Figure 2:
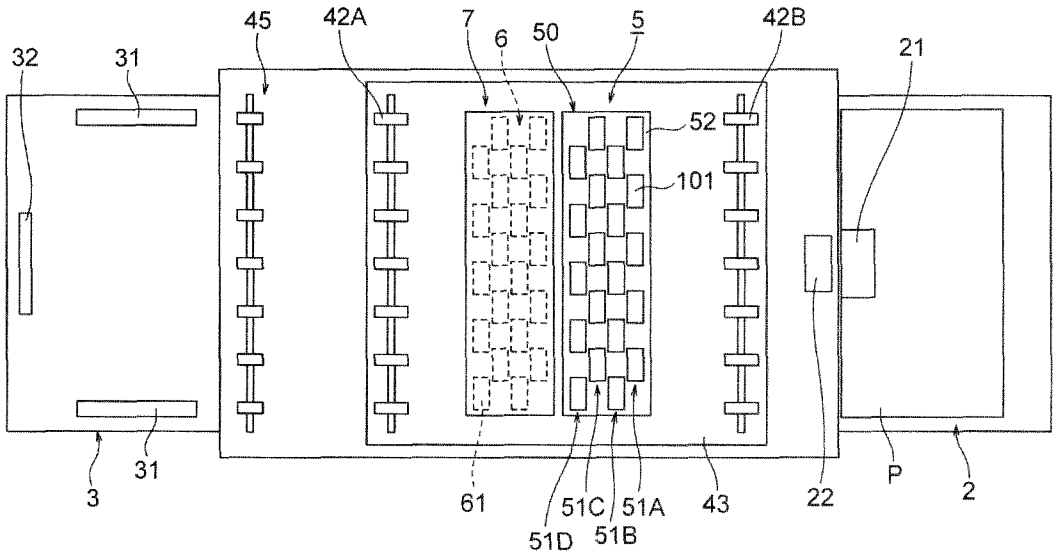
FIG. 2 is a schematic plan explanatory diagram of the device.

Hereinafter, an embodiment of the present invention will be explained with reference to the drawings. Firstly, an example of an image-forming device in which a head replacement is performed by using a head attachment/detachment jig and a head replacement jig according to an embodiment of the present invention will be explained with reference to FIG. 1 and FIG. 2. FIG. 1 is a schematic configuration diagram explaining an entire configuration of the image-forming device, and FIG. 2 is a schematic plan explanatory diagram of the image-forming device.

The image-forming device is a line-type image-forming device. The image-forming device has a device body 1, a paper-feeding tray 2 that stores and feeds paper P, and a paper-receiving tray 3 that receives and stacks paper P (printed paper). And in the device body 1, a conveyance part 4 that conveys paper P from the paper-feeding tray 2 to the paper-receiving tray 3, and an image-forming part 5 including a recording head that ejects droplets and prints images on paper P conveyed by the conveyance part 4 are arranged. Additionally, in the device body 1, a head maintenance device 6 that is a maintenance recovery mechanism that performs maintenance recovery of each head in the image-forming part 5 after completion of printing, or at a predetermined timing is included. Furthermore, a cleaner device 7 that cleans a cap member and a wiper member (blade device) of the head maintenance device 6 is included The device body 1 includes front and rear side plates, a stay, and so on (not illustrated). Paper P stored in the paper-feeding tray 2 is carried by a separation roller 21, and a paper-feeding roller 22 one by one.

The conveyance part 4 includes a conveyance driving roller 41A, a conveyance driven roller 41B, and an endless conveyance belt 43 wound around those rollers 41A and 41B. On a surface of the conveyance belt 43, a plurality of suction holes (not illustrated) are formed, and below the carrier belt 43, a suction fan 44 that sucks paper P is arranged. In addition, above the conveyance driving roller 41A and the conveyance driven roller 41B, conveyance guide rollers 42A, 42B are held by guides (not illustrated), and in contact with the conveyance belt 43 by their own weight, respectively. The suction holes are used when performing empty ejection.

The conveyance belt 43 circularly moves by the conveyance driving roller 41A rotated by a motor (not illustrated), and paper P is sucked by the suction fan 44, and conveyed by the circular movement of the conveyance belt 43. The conveyance driven roller 41B, and the conveyance guide rollers 42A, 42B are rotated along by the conveyance belt 43.

Above the conveyance part 4, the image-forming part 5 that includes a head array unit that ejects droplets for printing images on paper P is arranged to be movable (movable up and down, here).

The image-forming part 5 includes a head array (recording head) 50 which has four head alignments 51A, 51B, 51C, 51D each including a plurality of heads 101 fixed on an array base member 52 as an array member. In the image-forming part 5, branch members (not illustrated) which supply ink to each head 101 of the head array 50 are arranged for each color. On an upstream side of the branch members, a sub-tank (not illustrated) is arranged, and an appropriate negative pressure to maintain a meniscus of a nozzle of each head 101 is formed by a differential head between the sub-tank and each head 101. Additionally, on an upstream side of the sub-tank, a main tank (not illustrated) that stores ink and is replaceable is arranged.

On a downstream side of the conveyance part 4, the conveyance guide 45 that ejects paper P to the paper-receiving tray 3 is arranged. At the conveyance guide 45 paper P that has been conveyed is ejected to the paper-receiving tray 3. The paper-receiving tray 3 includes a pair of side fences 31 that confine a width direction of paper P, and an end fence 32 that confines an end of paper P.

Above the conveyance part 4 and on the side of the image-forming part 5, the head maintenance device 6 that performs maintenance on the heads 101 is arranged. The head maintenance device 6 includes caps 61 that cap a nozzle surface corresponding to each head 101, suction devices 63 that are connected to the caps 61, and so on.

When performing head maintenance, after the image-forming device 5 moves up and slides above the head maintenance device 6, the head maintenance device 6 below the image-forming device 5 moves up, and performs a maintenance operation. While printing, the head maintenance device 6 evacuates to a position illustrated in FIG. 1, and the image-forming part 5 also moves to a position illustrated in FIG. 1.

Above the head maintenance device 6, the cleaner device 7 that cleans droplets (waste liquid) attached to the caps 61, and the like is arranged. The cleaner device 7 is arranged to be movable up and down in the vertical direction to a paper conveyance surface by a cleaner-moving device (not illustrated).

Figure 3:
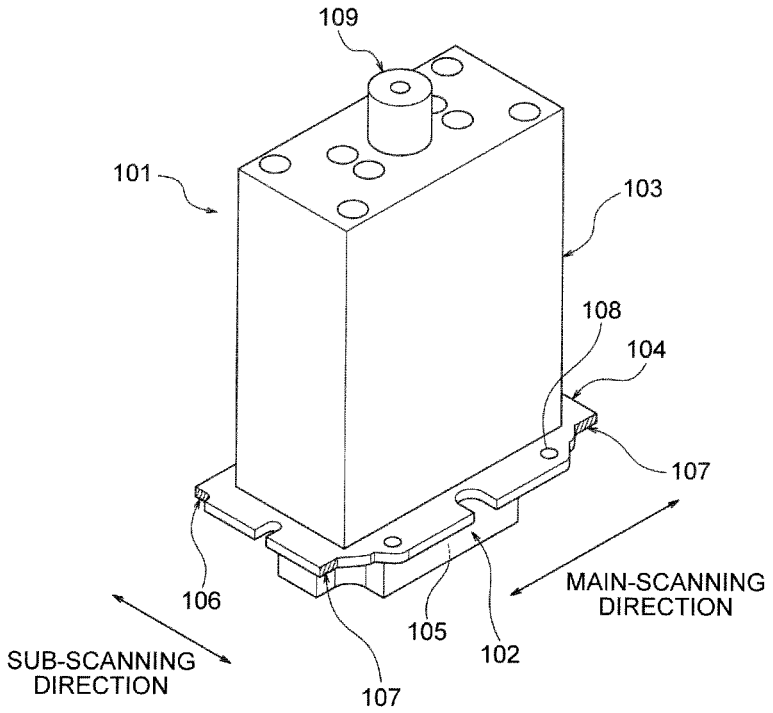
FIG. 3 is a perspective explanatory diagram illustrating an example of a head.
Figure 4:
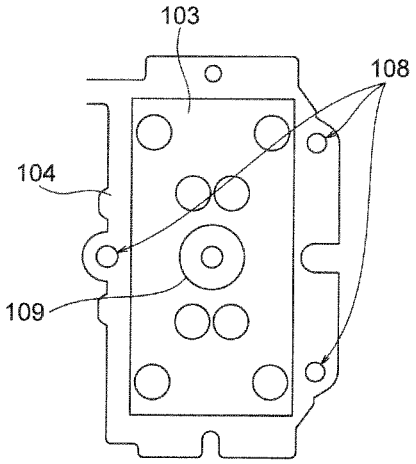
FIG. 4 is a plan explanatory diagram of the head.

Next, the configuration of the head 101 will be explained with reference to FIGS. 3 and 4. FIG. 3 is a perspective explanatory diagram, and FIG. 4 is a plan explanatory diagram of the head 101. Note that here, a long-side direction of the head 101 is a main-scanning direction, and a short-side direction of the head 101 is a sub-scanning direction; however, the head 101 itself is not scanned (moved).

The head 101 includes the head part 102, and the head tank 103, and is a head unit where the head part 102 and the head tank 103 are integrally formed, and attached to a head frame 104. The head part 102 includes an ejection device that ejects ink droplets. The head tank 103 supplies ink to the head part 102. As the ejection device that ejects the ink droplets, there are a so-called piezo type that generates pressure in an ink liquid by volume displacement in a pressurized liquid chamber generated by operation of a piezoelectric element as an electromechanical transducer element, and obtains kinetic energy for ink droplet ejection from the pressure, an electrostatic type that uses an electrostatic actuator as an electromechanical transducer element, and a so-called thermal type that generates air bubbles in an ink liquid by an electrothermal transducer element, removes ink by expansion of the air bubbles, and obtains kinetic energy for ink droplet ejection, and the like.

Additionally, in the head frame 104, a main-scanning-direction reference plane 106 and a sub-scanning-direction reference plane 107 that accurately show positions with respect to nozzles provided on a nozzle surface 105 as a surface on a lower side of the head part 102 in FIG. 3 are provided.

Additionally, in the embodiment of the present invention, for example, three fixing holes 108 for fixing the head 101 are provided on the head frame 104. The head 101 is fixed to the array base member 52 by fixing the head frame 104 to the array base member 52 by head-fixing screws 110 as fastener members.

Additionally, on a top surface of the head tank 103, a screw hole 109 that fixes a later-described head attachment/detachment jig 200 is provided.

Figure 5:
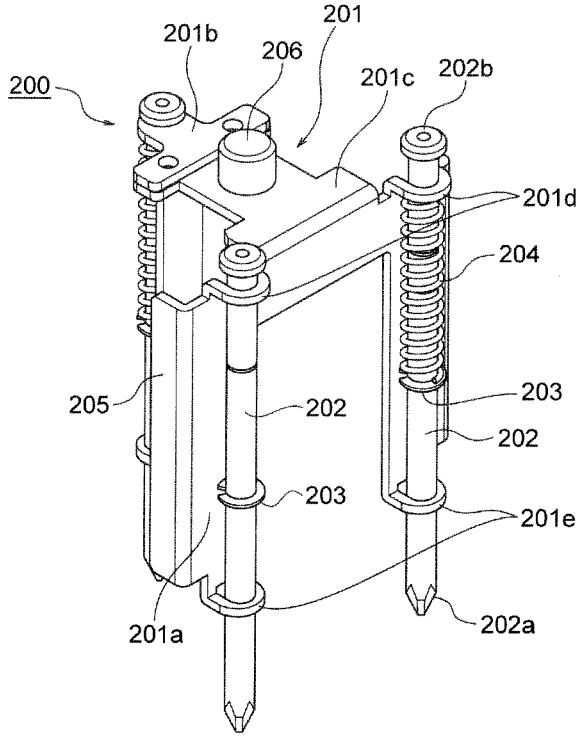
FIG. 5 is a perspective explanatory diagram of a head attachment/detachment jig according to a first embodiment of the present invention.

Next, a first example of a head attachment/detachment jig 200 according to the embodiment of the present invention will be explained with reference to FIG. 5. FIG. 5 is a perspective explanatory diagram of the head attachment/detachment jig 200.

The head attachment/detachment jig 200 includes a jig frame 201 as a frame member, and intermediate bits 202. Each intermediate bit 202 is equivalent to a bit as a tip tool that is held to be turnable and movable up and down (movable forward and backward) with respect to the jig frame 201. As described later, each intermediate bit 202 is a bit that is interposed between a tool such as a screwdriver, or the like and a fastener member as a screw, or the like. Each intermediate bit 202 includes a tip part 202*a* and a top part 202*b* at either end in the vertical direction, respectively. In the embodiment of the present invention, as many intermediate bits as the number of the head-fixing holes 108, that is, three intermediate bits, are provided.

The jig frame 201 includes a first bracket 201*a*, a second bracket 201*b*, and a top surface part 201*c*. On one side of the top surface part 201*c*, the first bracket 201*a* is located, and on the other side opposite to the one side, the second bracket 201*b* is located.

In the first bracket 201*a*, two intermediate bits 202 are arranged to be spaced from each other along the long-side direction of the head 101. In the first bracket 201*a*, holders 201*d*, 201*e* are provided at either end in the vertical direction with respect to each intermediate bit 202 so as to hold each intermediate bit 202 to be turnable and movable up and down. Each intermediate bit 202 is inserted into the holders 201*d*, 201*e*.

In the second bracket 201*b*, one intermediate bit 202 is arranged. In the second bracket 201*b*, the holders 201*d*, 201*e* are provided at either end in the vertical direction so as to hold the intermediate bit 202 to be turnable and movable up and down. The intermediate bit 202 is inserted into the holders 201*d*, 201*e*.

Each intermediate bit 202 of the head attachment/detachment jig 200 is provided with a pressing spring 204 as a pressing device, and an E-shaped stopper ring 203 as a stopper. The pressing spring 204 presses the intermediate bit 202 in a direction of moving forward (a direction of pressing the head-fixing screws 110). The intermediate bit 202 is inserted into the pressing spring 204. Between the E-shaped stopper ring 203, which is attached to the intermediate bit 202, and the holder 201*d* (a portion of the jig frame 201 by which each intermediate bit 202 is held), the pressing spring 204 is arranged.

The tip part 202*a* of each intermediate bit 202, as illustrated in later-described FIGS. 6A and 6B, has a shape that is capable of turning each of the head-fixing screws 110 by fitting in a top part of each head-fixing screw 110 as a fastener member that fastens the head 101 to the array base member 52. Here, the tip part 202*a* of each intermediate bit 202 has a shape of a tip of a screwdriver.

The top part 202*b* of each intermediate bit 202 protrudes upward from the holder 201*d* of the jig frame 201, and has a shape that is formed to be capable of turning each intermediate bit 202 by another tool. Here, since a screwdriver is used as such a tool, the top part 202*b* of each intermediate bit 202 has a shape that is formed to be a concave part that fits in a bit of the screwdriver; however, in a case of using another tool such as a spanner, a wrench, or the like, the shape can be formed to be capable of being turned by such a tool.

Additionally, the jig frame 201 includes a positioning guide part 205 as a guide part that determines a position in the horizontal direction with respect to the head tank 103, and accordingly with respect to the head frame 104. Here, the positioning guide part 205 is continuously formed with the first bracket 201*a*. Furthermore, the jig frame 201 includes a jig attachment/detachment screw 206 that is inserted into and fastened to a screw hole 109 of the head tank 103 and fixes the jig frame 201 to the head 101. The jig attachment/detachment screw 206 is located in the top surface part 201*c*.

It is preferable that the length of each intermediate bit 202 be longer than a distance between each head-fixing screw 110 of the head 101 and the top surface of the head tank 103 in a state where the head 101 is fixed by each head-fixing screw 110.

Next, a state where the head attachment/detachment jig 200 is set to the head 101 will be explained with reference to FIGS. 6A and 6B. Each of FIGS. 6A and 6B is a perspective explanatory diagram for explaining the state where the head attachment/detachment jig 200 is set to the head 101.

Firstly, as illustrated in FIG. 6A, the head detachment/attachment jig 200 is moved down (fitted in) from above the head 101 to butt an upper part of the head 101 such that the positioning guide part 205 of the jig frame 201 abuts a side surface of the head tank 103.

Then, as illustrated in FIG. 6B, the jig attachment/detachment screw 206 of the head attachment/detachment jig 200 is inserted into and fastened to the screw hole 109 of the head tank 103, and fixed to the head tank 103. In this state, the tip part 202*a* of each intermediate bit 202 is pressed against each head-fixing screw 110 by each pressing spring 204, and fitted into the top part of each head-fixing screw 110 as illustrated in FIG. 6B.

In a case of fixing or removing each head-fixing screw 110, it is possible to do so in a state where each intermediate bit 202 presses each head-fixing screw 110, and therefore, each intermediate bit 202 is turned by a tool in a stable state.

Next, an example of a head replacement jig 300 according to the embodiment of the present invention will be explained with reference to FIGS. 7 and 8. FIG. 7 is a perspective explanatory diagram of the head replacement jig 300, and FIG. 8 is a front explanatory diagram of the head replacement jig 300.

The head replacement jig 300 includes a main-scanning-direction jig 301, and a sub-scanning-direction jig 302.

The main-scanning-direction jig 301 includes a frame member 311, a main-scanning-direction adjusting taper screw 312, a main-scanning-direction pressing spring 313, and sub-scanning-direction pressing springs 314. The main-scanning-direction adjusting taper screw 312 adjusts a position by being in contact with the main-scanning-direction reference plane 106 of the head 101. The main-scanning-direction pressing spring 313 presses the head 101 in the main-scanning direction, and the sub-scanning-direction pressing springs 314 press the head 101 in the sub-scanning direction.

Additionally, the main-scanning-direction jig 301 includes jig-fixing screws 315 that fix the head replacement jig 300. In the embodiment of the present invention, in the main-scanning-direction jig 301, two jig-fixing screws 315 are provided to be spaced from each other along the long-side direction of the head 101. Each jig-fixing screw 315 has a tip part 315*a* and a top part 315*b* at either end in the vertical direction, respectively.

Each jig-fixing screw 315 is held to be movable up and down and turnable by the frame member 311. And an E-shaped stopper ring 316 is attached to each jig-fixing screw 315 such that each jig-fixing screw 315 does not slide more than a necessary stroke for attachment/detachment (so as to prevent the screw from dropping off).

Additionally, the tip part 315*a* of each jig-fixing screw 315 has a male screw shape that is capable of being screwed in the array base member 52. And the top part 315*b* of each jig-fixing screw 315 has a shape that is formed to be capable of turning each jig-fixing screw 315 by a tool. Here, since a screwdriver is used as such a tool, the top part 315*b* has a shape that is formed to be a concave part that fits in a bit of the screwdriver; however, in a case of using another tool such as a spanner, a wrench, or the like, the top part 315*b* can be a shape that is formed to be capable of turning each jig-fixing screw 315 by such a tool.

Therefore, here, each jig-fixing screw 315 is a stepped screw; however, it is not limited thereto.

On the other hand, the sub-scanning-direction jig 302 includes a frame member 321, a sub-scanning-direction adjusting taper screw 322, and sub-scanning-direction-jig pressing springs 323. The sub-scanning-direction adjusting taper screw 322 adjusts a position by being in contact with the sub-scanning-direction reference plane 107 of the head 101. Each sub-scanning-direction-jig pressing spring 323 presses the sub-scanning-direction jig 302 in the sub-scanning direction.

Additionally, similar to the main-scanning-direction jig 301, the sub-scanning-direction jig 302 also includes the jig-fixing screws 315 that fix the head replacement jig 300. In the embodiment of the present invention, also in the sub-scanning-direction jig 301, two jig-fixing screws 315 are provided to be spaced from each other along the long-side direction of the head 101. Each jig-fixing screw 315 has an tip part 315*a* and a top part 315*b* at either end in the vertical direction, respectively.

Next, a state where the head replacement jig 300 is set to the head 101 will be explained with reference to FIG. 9 and FIG. 10. FIG. 9 is a top explanatory diagram explaining the state where the head replacement jig 300 is set to the head 101, and FIG. 10 is a bottom explanatory diagram explaining the same state as in FIG. 9.

A position in the main-scanning direction of the head 101 is adjusted by up-down movement by turning of the main-scanning-direction adjusting taper screw 312 of the head replacement jig 300. As to a position in the sub-scanning direction, inclination is adjusted by turning movement of the head 101 centering on a sub-scanning-direction abutting reference 325 of the head replacement jig 300 by up-down movement by turning of the sub-scanning-direction adjusting taper screw 322. The position in the sub-scanning direction can be adjusted by ejection timing correction.

Here, each jig-fixing screw 315 included in the main-scanning-direction jig 301 is penetrated through an upper part and a lower part of the frame member 311, each jig-fixing screw 315 included in the sub-scanning-direction jig 302 is penetrated through an upper part and a lower part of the frame member 321, and each E-shaped stopper ring 316 as a stopper is attached between the upper part and the lower part of each of the frame members 311, 321. In this case, the length A in FIG. 8 is set to be longer than a stroke for loosening and removing each jig-fixing screw 315 of the head replacement jig 300, and is set to be shorter than the length B in FIG. 8 that is the length of each jig-fixing screw 315 which fits in each of the frame members 311, 321 in the lower part of the head replacement jig 300.

Thus, in a case of attachment/detachment of the head replacement jig 300, the jig-fixing screw 315 and the frame members 311, 321 can be integrally treated, and there is no problem of dropping off of the jig-fixing screws 315. An access part is provided in the upper part of the head replacement jig 300, and therefore, access to the deep and narrow area is resolved, and usability improves.

Next, the procedures for head replacement (head replacement steps) using the head attachment/detachment jig 200 and the head replacement jig 300 according to the embodiment of the present invention will be explained with reference to FIGS. 11A to 16.

Firstly, with reference to FIGS. 11A to 11C, the procedures (also referred to as steps) for fixing of the head replacement jig 300 and the head attachment/detachment jig 200 will be explained. Numbers in parentheses in FIGS. 11A to 11C, and also in the drawings that follow show the order of the procedures.

As illustrated in FIG. 11A, the main-scanning-direction jig 301 of the head replacement jig 300 is set to the array base member 52 from above the head array 50, as illustrated in FIG. 11B, the sub-scanning-direction jig 302 of the head replacement jig 300 is set to the array base member 52 from above the head array 50, and the main-scanning-direction jig 301 and the sub-scanning-direction jig 302 are fixed by each jig-fixing screw 315.

Then, as illustrated in FIG. 11C, the head attachment/detachment jig 200 is fixed to a head 101 to be removed by the jig attachment/detachment screw 206 from above the head array 50.

In those fixing operations, fixing is completed by turning the jig-fixing screws 315 and the jig attachment/detachment screw 206 as exclusive screws provided in the upper parts of the jigs, and therefore, poor workability and the problem of dropping off of the screws due to access to a bottom of the deep and narrow area by use of the screwdriver are resolved.

Next, with reference to FIGS. 12A and 12B, the procedures for removing screws for fixing the head 101 to be removed will be explained.

As illustrated in FIG. 12A, each intermediate bit 202 of the head attachment/detachment jig 200 fixed to the head 101 to be removed is turned, and as illustrated in FIG. 12B, each head-fixing screw 110 is removed.

Here, an arrow A in FIG. 12B indicates a state before a head-fixing screw 110 is loosened, and an arrow B in FIG. 12B indicates a state where a head-fixing screw 110 has been loosened and removed. In particular, the head-fixing screw 110 which has been loosened and removed is supported by an intermediate bit 202 and a head-fixing hole 108, and does not drop off, and additionally, because of the access to the upper part of the head attachment/detachment jig 200, operation workability by use of the screwdriver is good.

That is, since each head-fixing screw 110 is loosened and removed in a state where the jig attachment/detachment screw 206 of the head attachment/detachment jig 200 is fixed to the head 101, even when each head-fixing screw 110 is loosened, the pressure by each pressing spring 204 is exerted on each head-fixing screw 110, and therefore, none of the head-fixing screws 110 drop off.

Next, with reference to FIGS. 13A and 13B, the procedures for removing the head 101 to be removed will be explained.

As illustrated in FIG. 13A, after all the head-fixing screws 110 are loosened and removed, by lifting up the head attachment/detachment jig 200, the head 101 is removed with the head attachment/detachment jig 200.

At this time, as illustrated in FIG. 13B, when the head-fixing screws 110 are loosened, they are in a state indicated by an arrow B. And then the head 101 is lifted up, the head-fixing screws 110 are in a state indicated by an arrow A, and they are pressed with respect to the head-fixing holes 108 by the intermediate bits 202, and therefore, the problem of dropping off or the like does not occur.

The above-described procedures of removing the head 101 are summarized as follows.

(1) The head attachment/detachment screw 206 of the head attachment/detachment jig 200 is abutted to the jig-fixing screw hole 109 in the upper part of the head tank 103.

(2) The jig attachment/detachment screw 206 is turned, and the head attachment/detachment jig 200 is fixed to the head tank 103. In this state, each intermediate bit 202 presses each head-fixing screw 110, and each head-fixing screw 110 is held by each head-fixing hole 108.

(3) Each intermediate bit 202 is turned in a direction of loosening each head-fixing screw 110 by using a fastening tool such as a screwdriver, or the like.

(4) The head 101 fixed to the head attachment/detachment jig 200 is removed from the array base member 52. At this time, each head-fixing screw 110 is in a state of being pressed by each intermediate bit 202, and therefore, each head-fixing screw 110 is held between each intermediate bit 202 and each head-fixing hole 108, and the screws for fixing the head 101 do not drop off.

Next, with reference to FIGS. 14A and 14B, the procedures for setting the head attachment/detachment jig 200 to a new head 101 will be explained.

As illustrated in FIG. 14A, each head-fixing screw 110 is set to each head-fixing hole 108 of the new head 101. And the head attachment/detachment jig 200 is set from above the new head 101.

At this time, position adjustment in the horizontal direction with respect to the head tank 103, that is, with respect to the head 101, is performed by the guide part 205 of the head attachment/detachment jig 200. And when the new head 101 is fixed by the jig attachment/detachment screw 206 of the head attachment/detachment jig 200, as illustrated in FIG. 14B, each intermediate bit 202 of the jig attachment/detachment jig 200 is fitted in each head-fixing screw 110, and is in a state of holding each head-fixing screw 110.

Next, with reference to FIG. 15, the procedures for temporarily fixing the new head 101 to the array base member 52 and being capable of performing position adjustment will be explained.

Here, the new head 101 to which the head attachment/detachment jig 200 has been set is set from above the head array 50. And each intermediate bit 202 of the head attachment/detachment jig 200 is turned, and each head-fixing screw 110 is temporarily fixed so as to be capable of performing the position adjustment.

And then, the main-scanning-direction pressing spring 313, and the sub-scanning-direction pressing springs 314 of the main-scanning-direction jig 301 are set, and the reference planes (main-scanning-direction reference plane 106 and sub-scanning-direction reference plane 107) of the new head 101 are abutted to the main-scanning-direction adjusting taper screw 312, and the sub-scanning-direction adjusting taper screw 322, respectively, so as to be in a state of being capable of performing the position adjustment.

Next, with reference to FIG. 16, the procedures for adjusting a position of the new head 101 will be explained.

Here, the main-scanning-direction adjusting jig 312 of the main-scanning-direction jig 301, and the sub-scanning-direction adjusting jig 322 of the sub-scanning-direction jig 302 of the head replacement jig 300 are turned, and thereby the position of the new head 101 is adjusted. The position adjustment of the new head 101 is performed based on the output of a position adjustment chart, or the like, and reading an adjustment amount.

Then after the position adjustment is completed, each intermediate bit 202 of the head attachment/detachment jig 200 is turned by a tool such as a screwdriver, or the like, and each head-fixing screw 110 is fastened and each head 101 is fixed to the array base member 52.

Next, with reference to FIG. 17, the procedures for removing the jigs will be explained.

Here, each jig-fixing screw 315 of the sub-scanning-direction jig 302 is loosened, and the sub-scanning-direction jig 302 is removed above the head array 50. Each jig-fixing screw 315 of the main-scanning-direction jig 301 is loosened, and the main-scanning-direction jig 301 is removed above the head array 50. And the jig attachment/detachment screw 206 of the head attachment/detachment jig 200 is loosened, and the head attachment/detachment jig 200 is removed upward from the head 101.

As described above, the head replacement is completed.

Thus, by having a frame member attachable/detachable to a head, an intermediate bit held to be turnable and movable forward and backward, a tip part of the intermediate bit having a shape formed to be capable of turning a fastener member of the head, and a top part of the intermediate bit having a shape formed to be capable of turning the intermediate bit by a fastener tool, it is easy to replace the head fixed in a narrow and deep location.

That is, since the fastener tool such as a screwdriver is operated via the intermediate bit held by the frame member, it is possible to turn the fastener member in a relatively large work space with good visibility, and accordingly, it is possible to improve the workability of head replacement.

Next, with reference to FIG. 18, a second example of a head attachment/detachment jig 200 according to the embodiment of the present invention will be explained. FIG. 18 is a perspective explanatory diagram of the head attachment/detachment jig 200, in which the same reference numbers as in the first example are also used in the second example.

The second example has the same structure as that of the first example except for not having the pressing spring 204 in each intermediate bit 202 of the head attachment/detachment jig 200 in the first example.

Consequently, an intermediate bit 202 needs to have hardness necessary to turn, loosen, and fasten a head-fixing screw 110. The intermediate bit 202 is formed of a metal material such as SUS (Stainless Steel), iron, or the like, and therefore, the force acts downward in FIG. 18, that is, in a direction of pressing the above-described head-fixing screw 110, by its own weight of the intermediate bit 202.

Therefore, without the pressing spring 204, an effect similar to a case where the pressure is applied by the pressing spring 204 is obtained.

However, since the pressing force is its own weight, depending on a posture when the head 101 is removed, for example, when it is upside-down, the pressing force by its own weight does not act, and there is a possibility of the occurrence of dropping off of the head-fixing screw 110. Therefore, in that case, having a pressing spring as in the first example makes it possible to resolve a problem of the posture at the time of the head replacement.

Additionally, as illustrated in FIG. 18, the length A between each E-shaped stopper ring 203 attached to each intermediate bit 202 and each holder 201*d* (an upper end) of each of the brackets 201*a*, 201*b* of the jig frame 201 is larger than a stroke necessary for attachment/detachment of each head-fixing screw 110, and is smaller than the length B between each holder 201*e* (a lower end) of each of the brackets 201*a*, 201*b* and the tip part 202*a* of each intermediate bit 202. Therefore, each intermediate bit 202 does not drop off from each of the brackets 201*a*, 201*b* of the jig frame 201, and replacement workability improves as an integrated jig.

Note that in the present specification, the term "paper" is not limited to paper materials, but means those to which ink droplets, other liquid, and so on can be attached including an OHP (Overhead Projector) sheet, a cloth, a glass, a substrate, and so on. The term "paper" includes what is referred to as "a recorded medium", "a recording medium", "a recording paper", and so on.

"Image-forming", "image formation", "recording", and "printing" are used as a term having the same meaning.

The term "image-forming device" means a device that performs image formation by ejecting liquid to mediums such as paper, yarn, fiber, cloth, leather, plastics, glass, wood, ceramics, and so on. And the term "image-forming" or "image formation" means not only applying an image having meanings such as letters, figures, and the like to a medium, but also applying an image without meanings such as patterns, and the like to a medium (for example, simply attaching a droplet to a medium).

The term "ink" is not limited to what is referred to as "ink", but is used as a general term for all liquids that are capable of performing image formation such as what is referred to as "a recording liquid", "a fusing process liquid", "liquid", and the like, and for example, "a DNA sample", "a resist", "a pattern material", "a resin", and so on are also included in the term "ink".

The term "image" is not limited to a planar image, but includes an image applied to a 3D structure, or a 3D image.

According to the embodiment of the present invention, it is easily possible to replace a head fixed in a narrow and deep location.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A jig for attachment and detachment of a recording head, the jig comprising:

a frame member and a tip tool that has a tip part and a top part, and is held to be turnable and movable forward and backward with respect to the frame member, wherein the tip part of the tip tool has a shape of a tip of a screwdriver, to fit to a top of a screw, and the top part of the tip tool has a shape that is formed to be capable of turning the tip tool by a different tool from the tip tool, wherein the top part of the tip tool is disposed on an end, in an axial direction, of the tip tool, and the tip part of the tip tool is disposed on an opposite end, in the axial direction of the tip tool, relative to the top part, wherein the top part of the tip tool protrudes above a top surface of the frame member in the axial direction away from, and opposite to, the tip part of the tip tool, and wherein the top surface of the frame member is positioned closer to the end of the tip tool that is opposite to the tip part of the tip tool.

2. The jig according to claim 1, comprising a pressing member that presses the tip tool against the screw.

3. The jig according to claim 2, wherein the tip tool is provided with a stopper, and the pressing member is arranged between the stopper and a portion of the frame member by which the tip tool is held.

4. The jig according to claim 1, wherein the frame member includes a guide part that determines a position in a horizontal direction with respect to an object affixed by the screw.

5. The jig according to claim 1, wherein a length of the tip tool is longer than a distance between the screw and a top surface of an object affixed by the screw, in a state where the object is affixed by the screw.

6. The jig according to claim 1, wherein the frame member is fixed to a top surface of an object by the screw.

7. The jig according to claim 1, wherein the frame member includes a top surface part, a first bracket member disposed on one side of the top surface part, and a second bracket member disposed on an other side opposite to the one side of the top surface part, wherein each of the first bracket member and the second bracket member is provided with two holders configured to hold the tip tool and disposed to be spaced from each other along an axial direction of the tip tool, and wherein the tip tool inserted into the holders is held by the frame member.

8. A jig for adjusting a head position of a recording head fixed to a base member, comprising:

an adjusting part disposed to be in contact with the recording head to adjust the head position of the recording head fixed to the base member;

a frame member; and a jig-fixing screw that has a tip part and a top part, is held to be turnable and movable forward and backward with respect to the frame member, and fixes the jig on the base member, wherein the tip part of the jig-fixing screw has a shape that is capable of being screwed in the base member, and the top part of the jig-fixing screw has a shape that is formed to be capable of turning the jig-fixing screw by a tool, wherein the top part is disposed on an end, in an axial direction, of the jig-fixing screw, and the tip part is disposed on an opposite end, in the axial direction of the jig-fixing screw, relative to the top part, wherein the top part of the jig-fixing screw protrudes above a top surface of the frame member in the axial direction away from, and opposite to, the tip part of the jig-fixing screw, and wherein the top surface of the frame member is positioned closer to the end of the jig-fixing screw that is opposite, in the axial direction, to the tip part of the jig-fixing screw.

* * * * *